US005622278A

United States Patent [19]

Fries et al.

[11] Patent Number: 5,622,278

[45] Date of Patent: Apr. 22, 1997

[54] LADDER CADDY

[76] Inventors: Randy L. Fries; Lori Meschen, both of 2121 Apricot Ct., Pittsburg, Calif. 94565

[21] Appl. No.: 558,396

[22] Filed: Nov. 16, 1995

[51] Int. Cl.[6] ..... B65D 25/04

[52] U.S. Cl. ..... 220/480; 206/373; 220/503; 220/505; 220/554; 220/527

[58] Field of Search ..... 220/480, 475, 220/570, 554, 527, 503, 504, 505, 212.5; 206/372, 373; 182/129; 248/238; 312/902, 240, 290, 328, 235.2

[56] References Cited

U.S. PATENT DOCUMENTS

| | | | |
|---|---|---|---|
| 4,195,889 | 4/1980 | Coyne | 312/902 |
| 4,241,833 | 12/1980 | Luebcke | 312/902 |
| 4,356,854 | 11/1982 | McGee . | |
| 4,550,803 | 11/1985 | Finster et al. . | |
| 4,730,802 | 3/1988 | Chatham et al. | 182/129 |
| 4,880,810 | 11/1989 | Hall . | |
| 5,076,437 | 12/1991 | Schindler | 220/503 |
| 5,342,008 | 8/1994 | Kay | 182/129 |
| 5,370,263 | 12/1994 | Brown . | |
| 5,439,108 | 8/1995 | Lackie | 220/527 |
| 5,505,302 | 4/1996 | Ferley | 248/238 |

FOREIGN PATENT DOCUMENTS

| | | | |
|---|---|---|---|
| 17383 | 6/1913 | Denmark | 220/554 |

*Primary Examiner*—Stephen J. Castellano
*Attorney, Agent, or Firm*—Michael I. Kroll

[57] ABSTRACT

A ladder caddy (10) for a stepladder (12) comprising a container (14) for storing articles therein. A structure (16) is for retaining the container (14) in a removable manner to an upper back portion of the stepladder (12), so that a person (18) standing on and about the stepladder (12) can retrieve the articles from the container (14).

12 Claims, 4 Drawing Sheets

10
38
40
42
36
24
42
44
3
14
16
26
46
32
12
20
22
37
34
2
34
37
10
70
68
36
36
16
78
76
12
14
32
80
32
28
72
20
74
37
37

6
38
42
36
46
16
22
44
72
76
10
68
26
32
70
74
14
12
20
24
28
32
37
34
34
37

LADDER CADDY

BACKGROUND OF THE INVENTION

1. Field of the Invention

The instant invention relates generally to ladder implement holders and more specifically it relates to a ladder caddy.

2. Description of the Prior Art

Numerous ladder implement holders have been provided in prior art. For example, U.S. Pat. Nos. 4,356,854 to McGee; 4,4480,810 to Hall; 4,550,803 to Finster et al. and 5,370,263 to Brown all are illustrative of such prior art. While these units may be suitable for the particular purpose to which they address, they would not be as suitable for the purposes of the present invention as heretofore described.

MCGEE, ELLIS

WORK POUCH

U.S. Pat. No. 4,356,854

A work pouch has a central compartment configured to fit the top of a pedestal such as a stepladder. A depending skirt which hangs over the top portion of the pedestal, has a plurality of side compartments. The work pouch provides storage of tools, equipment and supplies convenient to a person on a stepladder or scaffold.

HALL, JEFFREY J.

LADDER CADDY

U.S. Pat. No. 4,480,810

A ladder caddy particularly adapted for attachment to a step or extension ladder for containing work implements is provided. The ladder caddy comprises a container member including side edge portions adapted to engage associated ladder side rails and a clamping member depending from the container member for clamping the ladder caddy to a ladder. The clamping member includes a first portion comprising a first support shoulder and first support flange generally normally depending therefrom, and a second portion selectively adjustable to the first portion comprising a second support shoulder generally opposite of the first support shoulder and a second support flange generally normally depending from the second support shoulder. Means are provided for selectively fastening the clamping member first portion to the clamping member second portion, whereby the ladder caddy may be attached to a ladder.

FINSTER, EMMA R.

FINSTER, PETER W.

ADJUSTABLE IMPLEMENT HOLDER FOR STEPLADDERS

U.S. Pat. No. 4,550,803

The present invention comprises an apparatus for adjustably supporting diverse articles on a stepladder. The apparatus includes in general an article securing means releasably supported in a support unit, which is mounted for relative rotation with respect to a base unit. In addition, a releasable locking means operatively controls the relative rotation between the support unit and the base unit. A mounting bracket unit is also provided, to securely engage the base unit on the stepladder.

BROWN, HARRY L.

LADDER CADDY

U.S. Pat. No. 5,370,263

A ladder caddy includes a rigid tray and a ladder-engaging handle, which together define a generally rectangular mounting opening positioned laterally adjacent a mounting side of the tray. The mounting opening is of a size and shape for receiving therein an apex portion and portions of leg pairs of an A-frame ladder when the legs are in a separated, deployed configuration, but sufficiently small that the ladder-engaging handle and the rigid tray contact the separated leg pairs of the ladder near the apex portion, whereby the ladder caddy remains mounted on the A-frame ladder. The ladder-engaging handle comprises two follower arms, which are slideably engaged in track slots of the rigid tray. The ladder-engaging handle also includes an outer member, or yoke bar, which is rotatably attached to the follower arms and which can be rotated to change the size of the mounting opening. A separate top handle can be rotated between a vertical, deployed position and a horizontal, stored position.

SUMMARY OF THE INVENTION

A primary object of the present invention is to provide a ladder caddy that will overcome the shortcomings of the prior art devices.

Another object is to provide a ladder caddy that can be attached to any type of stepladder without altering the stepladder in any form or compromising safety factors and regulations.

An additional object is to provide a ladder caddy that is a time saving device because of its storage capabilities and maneuverability, while it allows a person on the stepladder free movement, since it removes the fear of dropping tools which may cause potential injuries.

A further object is to provide a ladder caddy that is simple and easy to use.

A still further object is to provide a ladder caddy that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
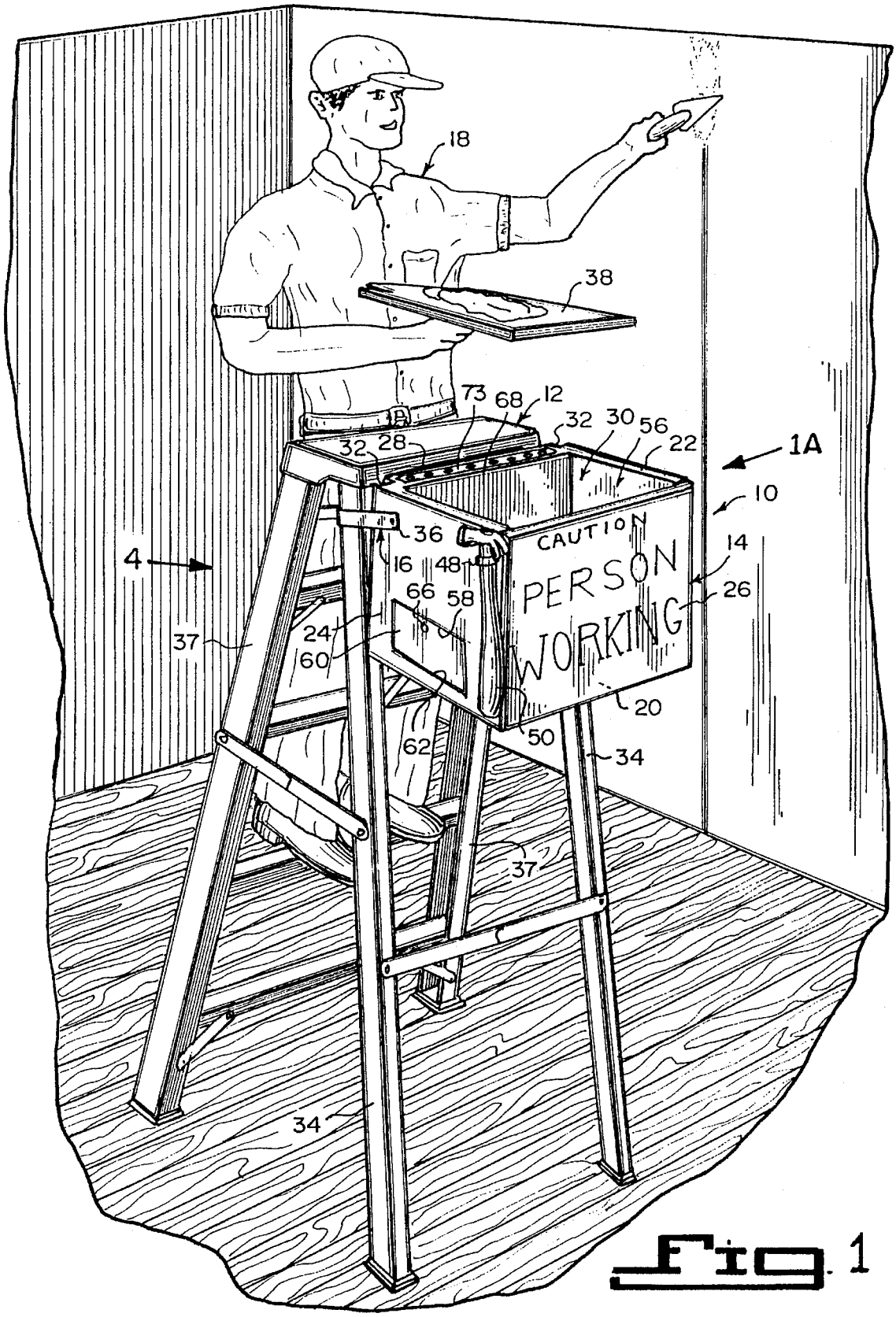
FIG. 1 is a perspective view of the instant invention mounted on a stepladder and in use.
Figures 1A, 2, 3:
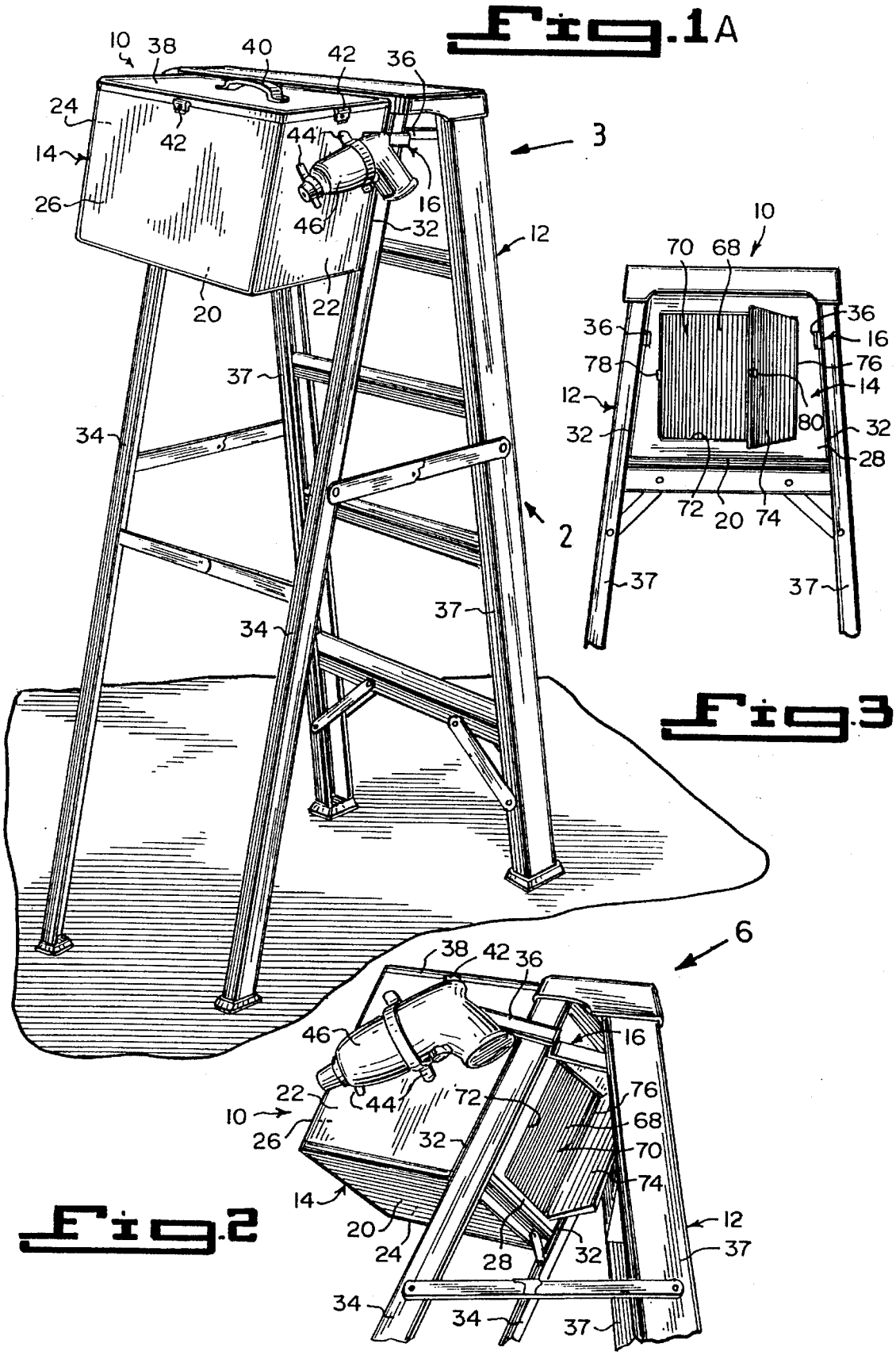
FIG. 1A is a perspective view taken in the direction of arrow 1A in FIG. 1, with the person removed from the stepladder.
FIG. 2 is a perspective view taken in the direction of arrow 2 in FIG. 1A with the lower portion of the stepladder broken away.
FIG. 3 is an elevational view taken in the direction of arrow 3 in FIG. 1A, with the lower portion of the stepladder broken away.
Figure 4:
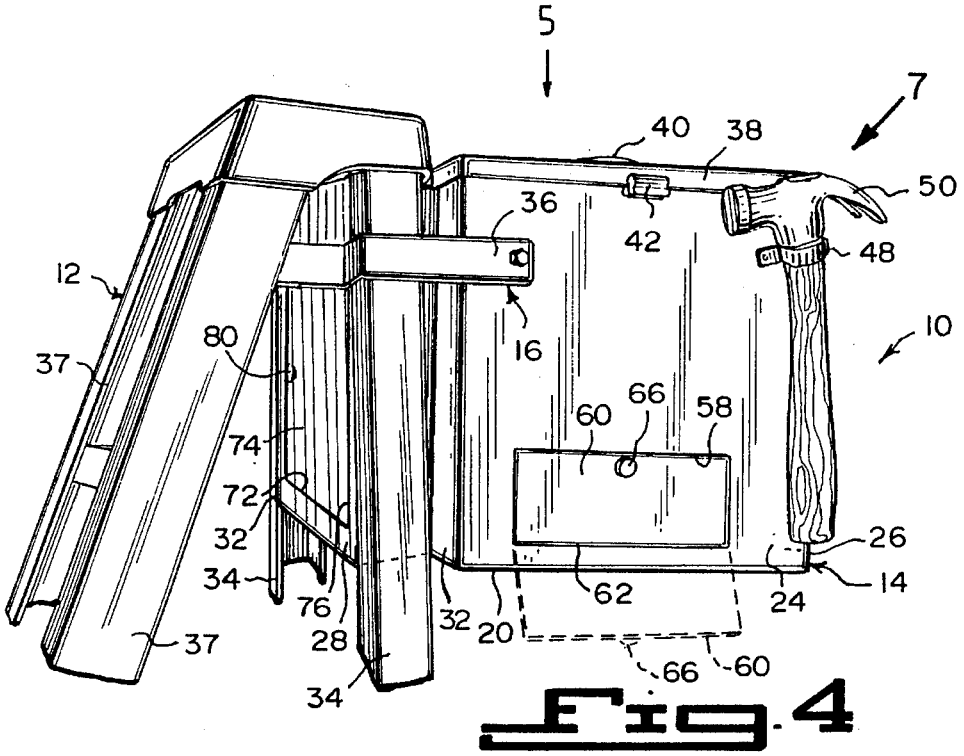
FIG. 4 is a perspective view taken in the direction of arrow 4 in FIG. 1, with the lower portion of the stepladder broken away.
Figure 5:
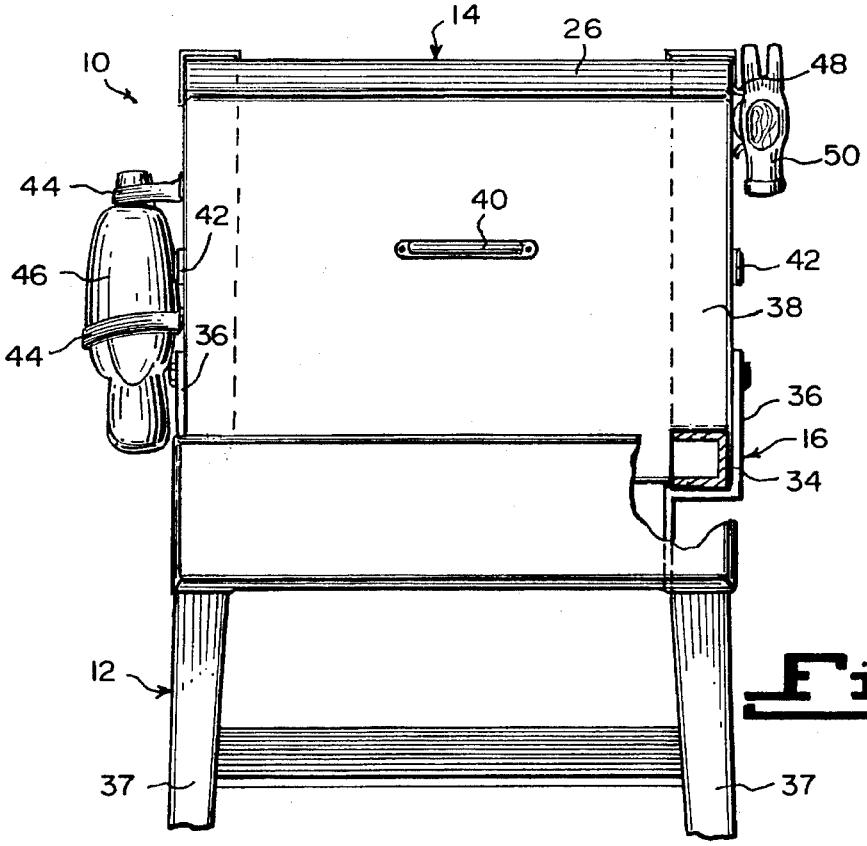
FIG. 5 is a top view taken in the direction of arrow 5 in FIG. 4.
Figure 6:
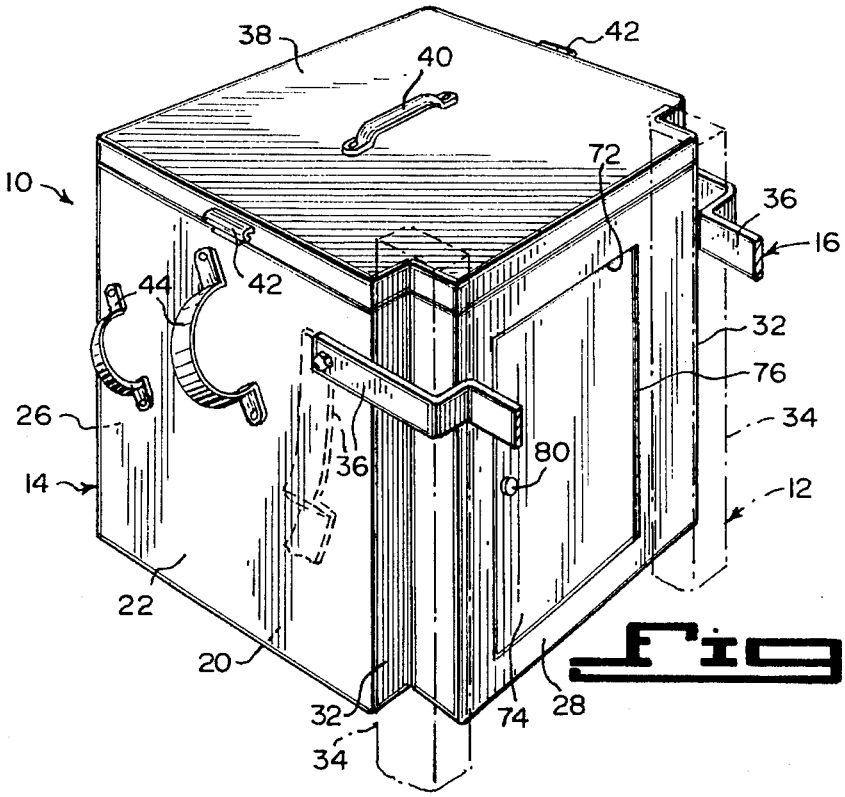
FIG. 6 is a perspective view taken in the direction of arrow 6 in FIG. 2, with a portion of the stepladder shown in phantom and the drill removed from its holster.

Turning now descriptively to the drawings, in which similar reference characters denote similar elements throughout the several views, FIGS. 1 through 7 illustrate a ladder caddy 10 for a stepladder 12 comprising a container 14 for storing articles therein. A structure 16 is for retaining the container 14 in a removable manner to an upper back portion of the stepladder 12, so that a person 18 standing on and about the stepladder 12 can retrieve the articles from the container 14.

The container 14 includes a bottom wall 20, with a pair of side walls 22, 24 that extend upwardly from the bottom wall 20. A front wall 26 extends upwardly from the bottom wall 20, while a rear wall 28 extends upwardly from the bottom wall 20, so as to form an open top compartment 30 therein.

The retaining structure 16 consists of the rear wall 28 of the container 14 having notched corners 32, to fit against rear side rails 34 of the stepladder 12. A pair of stepped clips 36 on the side walls 22, 34 of the container 14 clamp onto the rear side rails 34 and engage with front side rails 37 of the stepladder 12 to hold the container 14 thereto in a stationary position.

A lid 38 fits over the open top compartment 30 of the container 14. The lid 38 contains a handle 40, so that a person 18 can grasp the handle 40, to remove the lid 38 from and replace the lid 38 onto the container 14. A plurality of latches 42 are between the container 14 and the lid 38, so as to keep the lid 38 maintained thereto.

The container 14 further includes a first holster 44 secured to the first side wall 22, for holding an electric drill 46 thereto when not in use. The container 14 also includes a second holster 48 secured to the second side wall 24, for holding a hammer 50 thereto when not in use.

Figure 7:
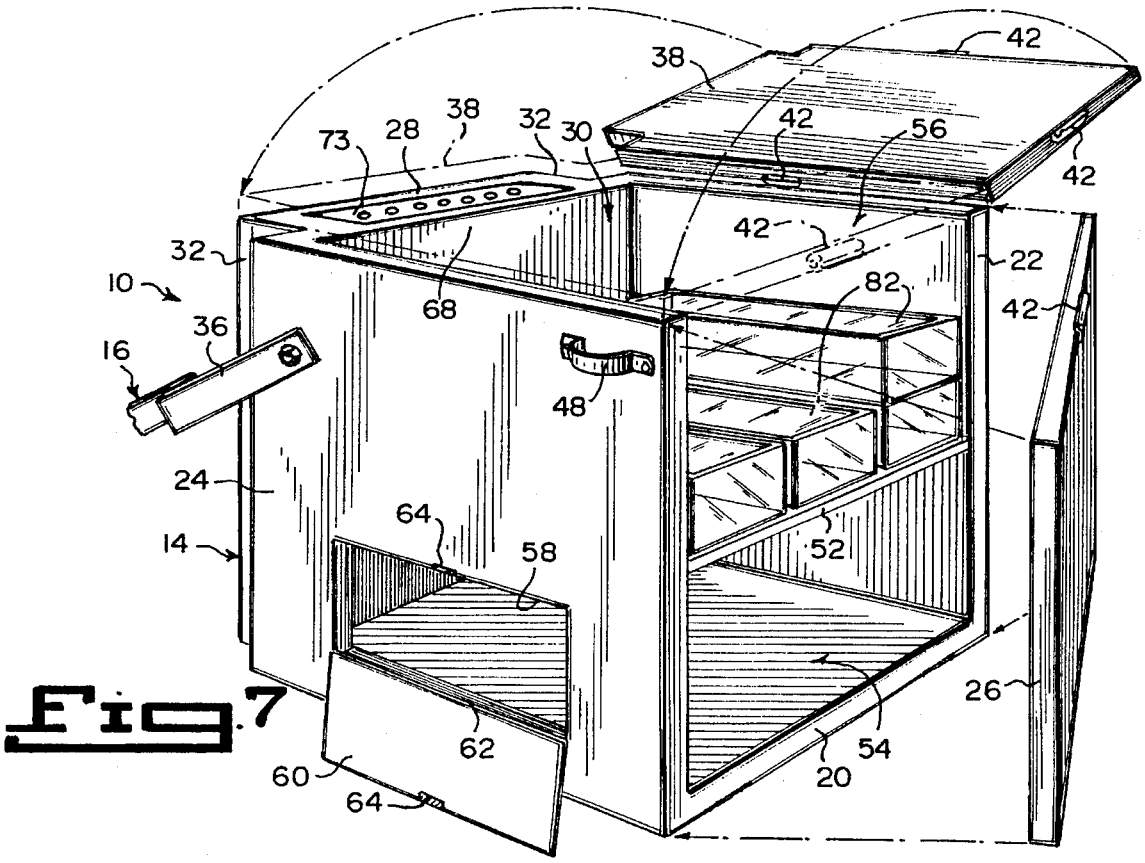
FIG. 7 is a partly exploded perspective view of the instant invention per se taken in the direction of arrow 7 in FIG. 4, with the hammer removed from its holster.

As best seen in FIG. 7, a horizontal partition 52 is positioned midway and extends between the side walls 22 and 24, so as to divide the open top compartment 30 into a lower storage chamber 54 and an upper storage chamber 56. One of the side walls 24 has a lower aperture 58 therethrough, to gain access into the lower storage chamber 54.

A side door 60 is sized to fit into the lower aperture 58 in the side wall 24 of the container 14. A hinge 62 is between a bottom edge of the side door 60 and the lower aperture 58. A latch 64 is between a top edge of the side door 60 and the lower aperture 58. A knob 66 on the side door 60 is to be grasped, so that the side door 60 can be opened and closed.

A vertical partition 68 is positioned near the rear wall 28, so as to form a narrow rear storage chamber 70 within the open top compartment 30 of the container 14. The rear wall 28 has an opening 72 therethrough, to gain access into the narrow rear storage chamber 70. A holder 73 for screwdrivers and pliers is sized to fit into top of the narrow rear storage chamber 70 in the container 14.

A rear door 74 is sized to fit into the opening 72 in the rear wall 28 of the container 14. A hinge 76 is between a first side of the rear door 74 and the opening 72. A latch 78 is between a second side of the rear door 74 and the opening 72. A knob 80 on the rear door 74 is to be grasped, so that the rear door 74 can be opened and closed.

As shown in FIG. 7, a plurality of small storage boxes 82 can be placed in a removable manner upon the horizontal partition 52 within the upper storage chamber 56 in the container 14. The small storage boxes 82 can hold a variety of small objects therein. The small storage boxes 82 can be, but not limited to, the size of 4"×4"×3½" and be of a total of twelve in number.

OPERATION OF THE INVENTION

To install the improved ladder caddy 10 onto the stepladder 12 for use, the following steps should be taken:

1. Place the notched corners 32 of the rear wall 28 of the container 14 against the upper portions of rear side rails of the opened stepladder 12.
2. Clamp the pair of stepped clips 36 onto the rear side rails 34 of the stepladder 12 and to engage with the front side rails 37.
3. Put the small storage boxes 82 filled with different small objects onto the horizontal partition 52 in the upper storage chamber 56.
4. Cover the container 14 with the lid 38.
5. Open the side door 60 and insert various tools and objects into the lower storage chamber 54.
6. Open the rear door 74 and insert other tools and objects into the narrow rear storage chamber 70.
7. Insert the electric drill 46 in the first holster 44.
8. Insert the hammer 50 in the second holster 48.
9. The improved ladder caddy 10 is now ready to be used.

LIST OF REFERENCE NUMBERS

| | |
|---|---|
| 10 | ladder caddy |
| 12 | stepladder |
| 14 | container of 10 |
| 16 | retaining structure of 10 |
| 18 | person |
| 20 | bottom wall of 14 |
| 22 | first side wall of 14 |
| 24 | second side wall of 14 |
| 26 | front wall of 14 |
| 28 | rear wall of 14 |
| 30 | open top compartment in 14 |
| 32 | notched corner on 28 |
| 34 | rear side rail of 12 |
| 36 | stepped clip on 22 and 24 |
| 37 | front side rail of 12 |
| 38 | lid |

-continued

| LIST OF REFERENCE NUMBERS | |
|---|---|
| 40 | handle on 38 |
| 42 | latch between 14 and 38 |
| 44 | first holster on 22 |
| 46 | electric drill for 44 |
| 48 | second holster on 24 |
| 50 | hammer for 48 |
| 52 | horizontal partition in 14 |
| 54 | lower storage chamber in 30 |
| 56 | upper storage chamber in 30 |
| 58 | lower aperture in 24 |
| 60 | side door in 58 |
| 62 | hinge between 58 and 60 |
| 64 | latch between 58 and 60 |
| 66 | knob on 60 |
| 68 | vertical partition in 14 |
| 70 | narrow rear storage chamber in 30 |
| 72 | opening in 28 |
| 73 | holder for screwdrivers and pliers into top of 70 |
| 74 | rear door in 72 |
| 76 | hinge between 72 and 74 |
| 78 | latch between 72 and 74 |
| 80 | knob on 74 |
| 82 | small storage box on 52 in 56 |

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A ladder caddy for a stepladder comprising:

a) a container for storing articles therein; said container including:

i) a bottom wall;

ii) a pair of side walls extending upwardly from said bottom wall;

iii) a front wall extending upwardly from said bottom wall;

iv) a rear wall extending upwardly from said bottom wall, so as to form an open top compartment therein;

v) a vertical partition positioned near said rear wall, so as to form a narrow rear storage chamber within said open top compartment of said container; and vi) said rear wall having an opening therethrough to gain access into said narrow rear storage chamber; and b) means for retaining said container in a removable manner to an upper back portion of the stepladder, so that a person standing on and about the stepladder can retrieve the articles from said container.

2. The ladder caddy as recited in claim 1, further including:

a) a rear door sized to fit into said opening in said rear wall of said container;

b) a hinge between a first side of said rear door and said opening;

c) a latch between a second side of said rear door and said opening; and d) a knob on said rear door to be grasped, so that said rear door can be opened and closed.

3. The ladder caddy as recited in claim 1, further including a holder for screwdrivers and pliers sized to fit into top of said narrow rear storage chamber in said container.

4. A ladder caddy for a stepladder comprising:

a) a container for storing articles therein; said container including:

i) a bottom wall;

ii) a pair of side walls extending upwardly from said bottom wall;

iii) a front wall extending upwardly from said bottom wall;

iv) a rear wall extending upwardly from said bottom wall, so as to form an open top compartment therein;

v) a horizontal partition positioned midway and extending between said side walls, so as to divide said open top compartment into a lower storage chamber and an Upper storage chamber;

vi) one of said side walls having a lower aperture therethrough to gain access into said lower storage chamber;

vii) a side door sized to fit into said lower aperture in said side wall of said container;

viii) a hinge between a bottom edge of said side door and said lower aperture;

ix) a latch between a top edge of said side door and said lower aperture; and x) a knob on said side door to be grasped, so that said side door can be opened and closed;

and b) means for retaining said container in a removable manner to an upper back portion of the stepladder, so that a person standing on and about the stepladder can retrieve the articles from said container.

5. A ladder caddy for a stepladder comprising:

a) a container for storing articles therein; said container including:

i) a bottom wall;

ii) a pair of side walls extending upwardly from said bottom wall;

iii) a front wall extending upwardly from said bottom wall;

iv) a rear wall extending upwardly from said bottom wall so as to form an open top compartment therein, said rear wall having notched corners to fit against rear side rails of the stepladder; and v) a pair of stepped clips on side walls of said container, which clamp onto the rear side rails of the stepladder and hold said container thereto in a stationary position;

b) means for retaining said container in a removable manner to an upper back portion of the stepladder, so that a person standing on and about the stepladder can retrieve the articles from said container;

c) a lid to fit over said open top compartment of said container, said lid including a handle, so that a person can grasp said hand to remove said lid from and replace said lid onto said container;

d) a plurality of latches between said container and said lid so as to keep said lid maintained thereto; and e) a first holster assembly secured to one of said side walls, for holding an electric drill thereto when not in use.

6. A ladder caddy as recited in claim 5, wherein said container further includes a second holster secured to other of said side walls for holding a hammer thereto when not in use.

7. The ladder caddy as recited in claim 6, further including:

a) a horizontal partition positioned midway and extending between said side walls, so as to divide said open top compartment into a lower storage chamber and an upper storage chamber; and b) one of said side walls having a lower aperture therethrough to gain access into said lower storage chamber.

8. The ladder caddy as recited in claim 7, further including:

a) a side door sized to fit into said lower aperture in said side wall of said container;

b) a hinge between a bottom edge of said side door and said lower aperture;

c) a latch between a top edge of said side door and said lower aperture; and d) a knob on said side door to be grasped, so that said side door can be opened and closed.

9. The ladder caddy as recited in claim 8, further including:

a) a vertical partition positioned near said rear wall, so as to form a narrow rear storage chamber within said open top compartment of said container; and b) said rear wall having an opening therethrough to gain access into said narrow rear storage chamber.

10. The ladder caddy as recited in claim 9, further including:

a) a rear door sized to fit into said opening in said rear wall of said container;

b) a hinge between a first side of said rear door and said opening;

c) a latch between a second side of said rear door and said opening; and d) a knob on said rear door to be grasped, so that said rear door can be opened and closed.

11. The ladder caddy as recited in claim 10, further including a holder for screwdrivers and pliers sized to fit into top of said narrow rear storage chamber in said container.

12. The ladder caddy as recited in claim 11, further including a plurality of small storage boxes, which can be placed in a removable manner upon said horizontal partition within said upper storage chamber in said container, so that said small storage boxes can hold a variety of small objects therein.

* * * * *